US008973628B2

(12) United States Patent
Kimmel

(10) Patent No.: US 8,973,628 B2
(45) Date of Patent: Mar. 10, 2015

(54) PORTABLE PURSE STRAP HOOK

(71) Applicant: Sally Kimmel, Shepherdstown, WV (US)

(72) Inventor: Sally Kimmel, Shepherdstown, WV (US)

( * ) Notice: Subject to any disclaimer, the term of this patent is extended or adjusted under 35 U.S.C. 154(b) by 246 days.

(21) Appl. No.: 13/660,735

(22) Filed: Oct. 25, 2012

(65) Prior Publication Data

US 2014/0116585 A1 May 1, 2014

(51) Int. Cl.
*A45F 5/10* (2006.01)
*B65D 33/06* (2006.01)

(52) U.S. Cl.
USPC ..... 150/106; 24/375; 24/376; 24/379.1; 24/378.1; 16/435

(58) Field of Classification Search
USPC ..... 150/106; 24/31 V, 343, 375 X, 376 X, 24/379.1 X, 378.1 X; 16/435 X
See application file for complete search history.

(56) References Cited

U.S. PATENT DOCUMENTS

| | | | | |
|---|---|---|---|---|
| 1,485,131 | A * | 2/1924 | Stallings | 206/37.5 |
| 1,822,502 | A * | 9/1931 | Reiter | 206/37.5 |
| D297,683 | S | 9/1988 | Beauchan | |
| 5,077,850 | A | 1/1992 | Brubaker | |
| 5,094,417 | A | 3/1992 | Creed | |
| 5,651,455 | A * | 7/1997 | Garcia | 206/287.1 |
| D394,956 | S * | 6/1998 | Fruecht | D3/318 |
| 5,794,312 | A | 8/1998 | O'Mahony | |
| 5,964,386 | A | 10/1999 | Cote | |
| 6,017,072 | A * | 1/2000 | Grant | 294/146 |
| 7,788,733 | B1 * | 9/2010 | Zahner | 2/16 |
| D652,211 | S * | 1/2012 | Morrison et al. | D3/255 |
| 2005/0161570 | A1 | 7/2005 | Bauerly | |
| 2007/0051768 | A1 * | 3/2007 | Dobson et al. | 224/666 |
| 2007/0175895 | A1 * | 8/2007 | Vlahos | 220/212.5 |
| 2006/0302841 | | 12/2008 | Conforti | |
| 2010/0178821 | A1 * | 7/2010 | Morris | 442/1 |
| 2011/0010903 | A1 | 1/2011 | Starbuck | |

FOREIGN PATENT DOCUMENTS

| | | |
|---|---|---|
| JP | 2004-245421 | 9/2004 |

* cited by examiner

*Primary Examiner* — Tri Mai
(74) *Attorney, Agent, or Firm* — Richard C Litman

(57) ABSTRACT

The portable purse strap hook is slidably and removably mounted on a purse strap. The portable purse strap hook includes a flexible sheet having at least one releasable fastener attached thereto for releasably fastening laterally opposed ends thereof to form a sleeve slidably disposed on the purse strap. A hook is pivotally secured to the inner surface of the flexible sheet. The hook is pivotal between a stored position within the sleeve and a position extending from the sleeve so that the hook may be used to hang the purse from a stationary support.

2 Claims, 3 Drawing Sheets

PORTABLE PURSE STRAP HOOK

CROSS-REFERENCE TO RELATED APPLICATION

This application claims the benefit of U.S. Provisional Patent Application Ser. No. 61/660,496, filed Jun. 15, 2012.

BACKGROUND OF THE INVENTION

1. Field of the Invention

The present invention relates to supports, and particularly to a portable retainer and support for purses, handbags and the like.

2. Description of the Related Art

Purses, handbags and the like are typically carried by the user to numerous locations throughout the day. When using a public restroom or visiting similar unsanitary locations, there is often no hygienic surface for supporting the purse or handbag while the user makes use of the facilities. The floors of such locations are not cleaned often enough to reliably rest the purse or handbag thereon, and not all public restroom stalls are provided with hooks for supporting the purse or handbag off above the floor. It would be desirable to provide a portable hook device which could be carried by the user in the purse or handbag for use in such situations.

Thus, a portable purse strap hook solving the aforementioned problems is desired.

SUMMARY OF THE INVENTION

The portable purse strap hook is a retainer for purse straps that is slidably and removably mounted on a purse strap. The portable purse strap hook includes a flexible sheet having opposed inner and outer surfaces. At least one releasable fastener is disposed on the sheet for releasably fastening laterally opposed ends of the flexible sheet to one another. The at least one releasable fastener may be a snap fastener, such that a male portion thereof is attached to one of the laterally opposed ends of the flexible sheet, and a female portion thereof is attached to the other one of the laterally opposed ends of the flexible sheet.

A hook is pivotally secured to the inner surface of the flexible sheet. Preferably, the hook includes opposed free and fixed ends, the hook portion being formed on the free end. The fixed end is pivotally secured to either the male or the female portion of the snap fastener. In use, when the flexible sheet is in an open configuration, the purse strap may be positioned to extend longitudinally across a central portion of the inner surface of the flexible sheet. The at least one releasable fastener is then fastened to secure the sheet around the purse strap, the flexible sheet in the closed configuration forming a sliding cuff about the purse strap. The hook is pivotally deployable from within the flexible sheet to extend outwardly therefrom.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
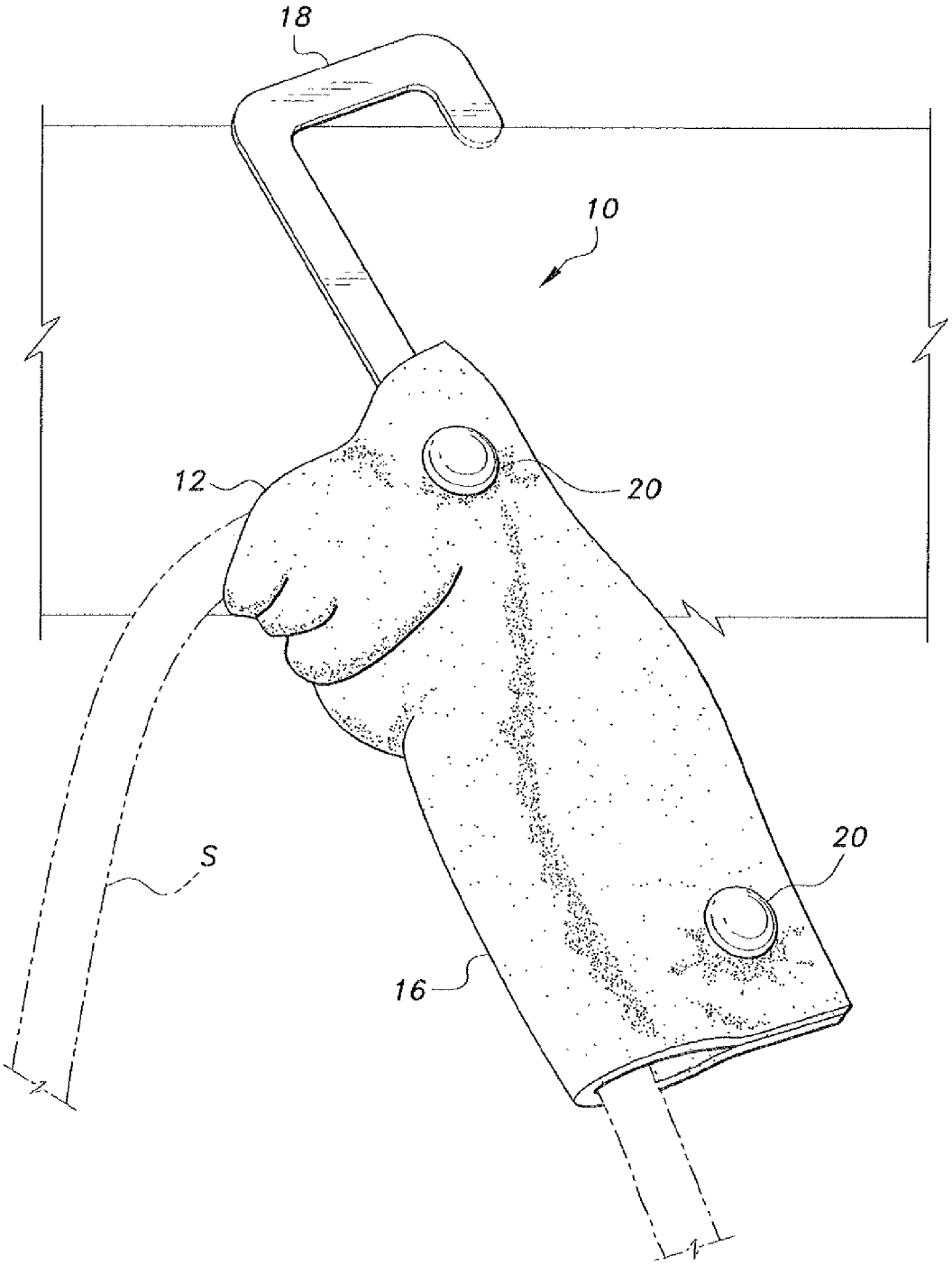
FIG. 1 is a perspective view of a portable purse strap hook according to the present invention.
Figure 2:
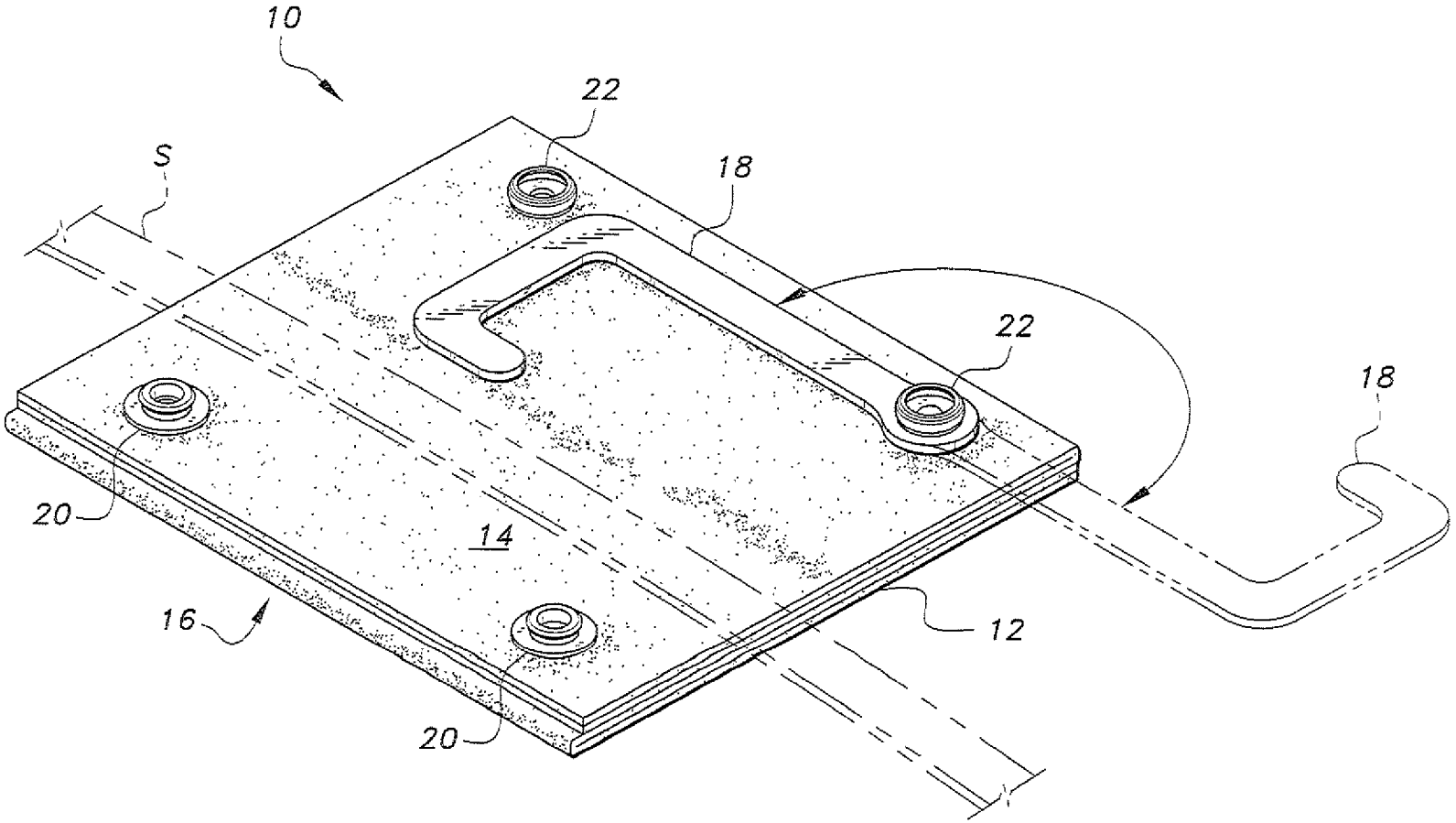
FIG. 2 is a perspective view of the portable purse strap hook of FIG. 1 in an open configuration.

As shown in FIG. 1, the portable purse strap hook 10 is slidably and removably mounted on a purse strap S. It should be understood that the portable purse strap hook 10 may be used with any type of purse, handbag or any other article including a strap or the like. As best shown in FIG. 2, the portable purse strap hook 10 includes a flexible sheet 12 having opposed inner and outer surfaces 14, 16, respectively. At least one releasable fastener is disposed on the sheet 12 for releasably fastening laterally opposed ends or sides of the flexible sheet 12 to one another. Although shown as being square in FIG. 2, it should be understood that flexible sheet 12 may have any desired dimensions or configuration. Exemplary dimensions for the flexible sheet 12 corresponding to the example shown in FIG. 2 include a lateral width of approximately four inches and a longitudinal length of approximately four inches. The flexible sheet 12 may be formed from any suitable type of material, such as leather, fabric or the like.

Figure 3:
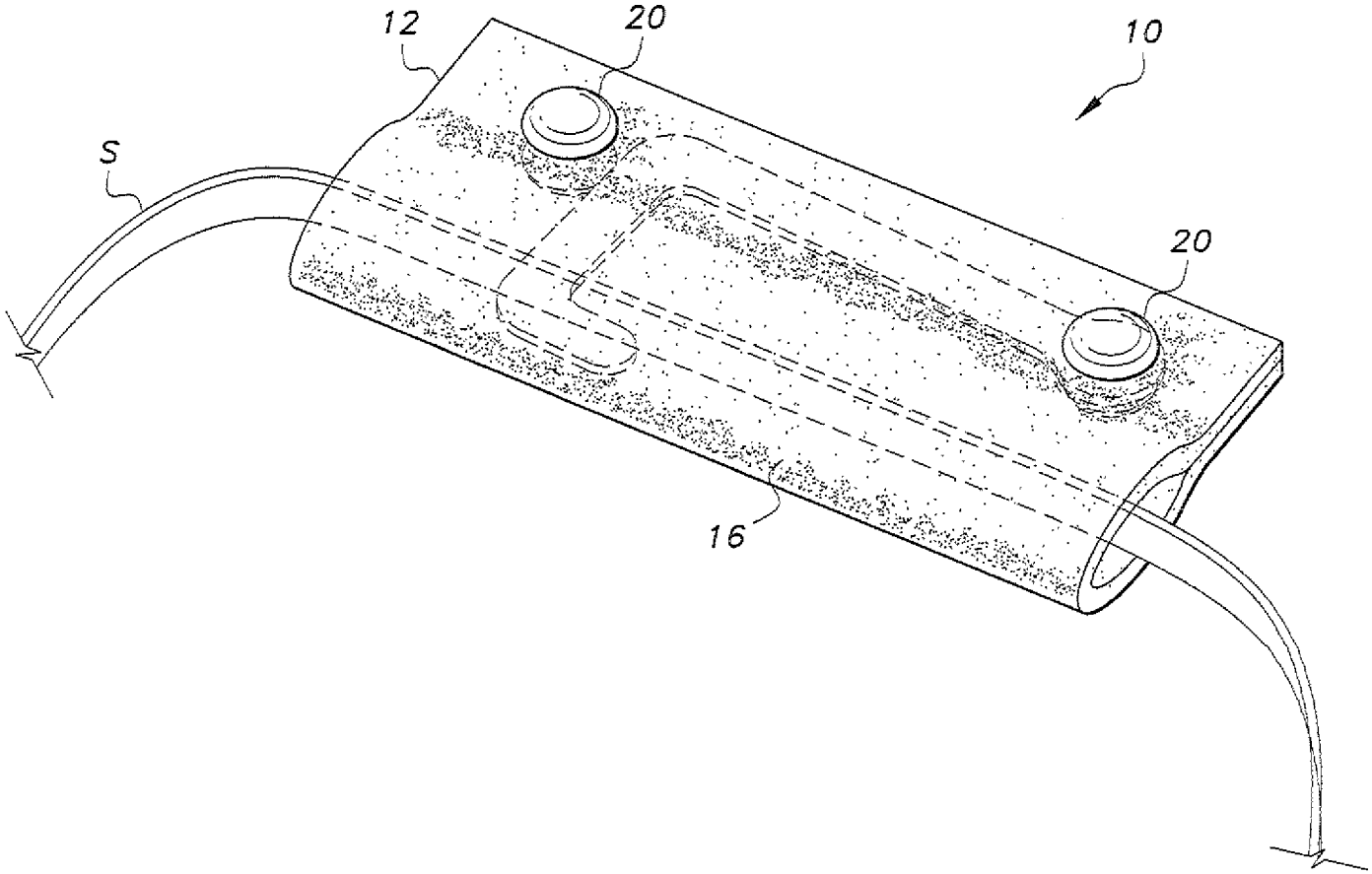
FIG. 3 is a perspective view of the portable purse strap hook of FIG. 1 in a closed configuration, showing the hook in a stored state.

Any suitable type of releasable fastener may be utilized. In the preferred embodiment, the releasable fastener is a snap fastener. As shown in FIGS. 1-3, a pair of snap fasteners are provided, although it should be understood that any desired number of fasteners, or any type of fasteners (e.g., mating hook and loop fasteners, a zipper, buttons etc.), may be utilized. In the embodiment illustrated, a male portion 20 of the snap fastener is secured to one of the laterally opposed ends of the flexible sheet 12, and a corresponding female portion 22 is secured to the other one of the laterally opposed ends of the flexible sheet 12. Using the exemplary dimensions given above for flexible sheet 12, the male and female portions 20, 22 are preferably positioned approximately one-quarter of an inch from the corresponding laterally-opposed edges of the flexible sheet 12.

A hook 18 is pivotally secured to the inner surface 14 of the flexible sheet 12. Preferably, the hook 18 includes opposed free and fixed ends, the hook portion being formed on the free end thereof. The fixed end, as shown, is pivotally secured to one of the male and female portions 20, 22 of the snap fastener. In FIG. 2, the fixed end of hook 18 is shown as being pivotally secured to one of the female portions 22, although it should be understood that the hook 18 may alternatively be secured to one of the male portions 20, or may be separately attached to the sheet 12 by a rivet or other pivot pin. Using the exemplary dimensions given above, the hook 18 is preferably approximately between one and one-half and two inches in length, allowing it to easily fit between the two female portions 22 when folded, as shown in solid lines in the configuration shown in FIG. 2. The hook 18 may be formed from any suitable material, such as flat brass or the like. An eyelet formed through the fixed end of the hook 18 is dimensioned to securely engage with the corresponding female fastener portion 22.

In use, when the flexible sheet 12 is in an open configuration (as in FIG. 2), the purse strap S may be positioned to extend longitudinally across a central portion of the inner surface 14 of the flexible sheet 12. The at least one releasable fastener is then fastened to hold the purse strap within the flexible sheet 12. The flexible sheet 12, in the closed configuration, forms a sliding sleeve or cuff about the purse strap S, as shown in FIG. 3. The hook 18 is pivotally deployable from within the flexible sheet 12 to extend outwardly therefrom, as in FIG. 1. This allows the purse associated with the purse strap S to be suspended from any desired support surface, such as a stall door or the like. In the closed configuration, the hook 18 pivoted to the stored state. The portable purse hook 10 may be easily carried within the purse or handbag for use as needed.

It is to be understood that the present invention is not limited to the embodiments described above, but encompasses any and all embodiments within the scope of the following claims.

I claim:

1. In combination, a bag having a strap and a portable bag strap hook adapted to be secured about the strap, comprising:

a bag having a strap;

a flexible, elongated sheet having opposed inner and outer surfaces, laterally opposed ends, and longitudinally opposed ends, the sheet being foldable around the strap of the bag, the laterally opposed ends of the sheet being secured to each other at the longitudinally ends to form a sleeve around the bag strap, wherein the sleeve is slidable on the bag strap;

a plurality of mating releasable snap fasteners disposed on the lateral ends of the sheet adjacent the longitudinal ends, wherein each of the releasable fasteners comprises a male portion attached to one of the laterally opposed ends of the flexible sheet and a mating female portion attached to the other one of the laterally opposed ends of the flexible sheet, whereby the sleeve is removably disposed on the bag strap; and a hook having a stem and an arcuately curved portion extending from the stem, wherein the stem of the hook has an eyelet defined therein, the eyelet being pivotally disposed directly on one of the snag fasteners, the arcuately curved portion of the hook being pivotal between the mating snap fasteners at the opposing longitudinal ends of the sleeve, the hook being pivotal between an open position in which the arcuately curved portion is adapted for hooking onto a support to suspend the bag, and a closed position in which the hook is stored entirely within the sleeve.

2. A portable bag strap hook adapted to be secured about the strap of a bag, consisting of:

a flexible, elongated sheet having opposed inner and outer surfaces, laterally opposed ends, and longitudinally opposed ends, the sheet being adaptable to folding around the strap of the bag, the laterally opposed ends of the sheet being secured to each other at the longitudinally ends to form a sleeve around the bag strap, wherein the sleeve is slidable on the bag strap;

a plurality of mating releasable snap fasteners disposed on the lateral ends of the sheet adjacent the longitudinal ends, wherein each of the releasable fasteners comprises a male portion attached to one of the laterally opposed ends of the flexible sheet and a mating female portion attached to the other one of the laterally opposed ends of the flexible sheet, whereby the sleeve is removably disposed on the bag strap;

a hook having a stern and an arcuately curved portion extending from the stem, wherein the stem of the hook has an eyelet defined therein, the eyelet being pivotally disposed directly on one of the snap fasteners, the arcuately curved portion of the hook being pivotal between the mating snap fasteners at the opposing longitudinal ends of the sleeve, the hook being pivotal between an open position in which the arcuately curved portion is adapted for hooking onto a support to suspend the bag, and a closed position in which the hook is stored entirely within the sleeve.

* * * * *